US010950374B2

(12) United States Patent
Koshiba et al.

(10) Patent No.: US 10,950,374 B2
(45) Date of Patent: Mar. 16, 2021

(54) FE-BASED ALLOY COMPOSITION, SOFT MAGNETIC MATERIAL, MAGNETIC MEMBERS, ELECTRIC/ELECTRONIC COMPONENT, AND DEVICE

(71) Applicants: Alps Alpine Co., Ltd., Tokyo (JP); Akita Prefectural University, Akita (JP)

(72) Inventors: Hisato Koshiba, Niigata-ken (JP); Takao Mizushima, Niigata-ken (JP); Takafumi Hibino, Akita-ken (JP); Teruo Bitoh, Akita-ken (JP)

(73) Assignee: Alps Alpine Co., Ltd., Tokyo (JP)

( * ) Notice: Subject to any disclaimer, the term of this patent is extended or adjusted under 35 U.S.C. 154(b) by 126 days.

(21) Appl. No.: 16/035,302

(22) Filed: Jul. 13, 2018

(65) Prior Publication Data

US 2018/0322991 A1 Nov. 8, 2018

Related U.S. Application Data

(63) Continuation of application No. PCT/JP2017/006428, filed on Feb. 21, 2017.

(30) Foreign Application Priority Data

Mar. 7, 2016 (JP) ..... JP2016-043817

(51) Int. Cl.
*C22C 45/02* (2006.01)
*H01F 1/153* (2006.01)
(Continued)

(52) U.S. Cl.
CPC ..... *H01F 1/15308* (2013.01); *C22C 33/003* (2013.01); *C22C 33/0278* (2013.01);
(Continued)

(58) Field of Classification Search
CPC ..... C22C 2202/02; C22C 33/003; C22C 33/0278; C22C 45/02; H01F 1/15308; H01F 3/04; H01F 3/08
(Continued)

(56) References Cited

U.S. PATENT DOCUMENTS 5,871,593 A * 2/1999 Fish ..... C22C 45/02 148/304
8,807,197 B2 * 8/2014 Branagan ..... C22C 45/02 164/114
(Continued)

FOREIGN PATENT DOCUMENTS

CN 101206943 6/2008
JP 55152150 A * 11/1980 ..... C21D 6/00
(Continued)

OTHER PUBLICATIONS

NPL: English abstract of JP-55152150 A, Nov. 1980 (Year: 1980).*
International Search Report for International Application No. PCT/JP2017/005256 dated May 16, 2017.

*Primary Examiner* — Jie Yang
(74) *Attorney, Agent, or Firm* — Beyer Law Group LLP

(57) ABSTRACT

Provided is an Fe-based alloy composition capable of forming an amorphous soft magnetic material which contains no P and which has a glass transition temperature $T_g$, the Fe-based alloy composition having a composition represented by the formula $(Fe_{1-a}T_a)_{100at\ \%-(x+b+c+d)}M_xB_bC_cSi_d$, where T is an arbitrary added element such as Ni and M is an arbitrary added element such as Cr, the formula satisfying the following conditions: 0≤a≤0.3, 11.0 at %≤b≤18.20 at %, 6.00 at %≤c≤17 at %, 0 at %≤d≤10 at %, and 0 at %≤x≤4 at %.

14 Claims, 7 Drawing Sheets

(51) Int. Cl.

| | |
|---|---|
| ***C22C 33/02*** | (2006.01) |
| ***H01F 3/08*** | (2006.01) |
| ***C22C 33/00*** | (2006.01) |
| ***H01F 3/04*** | (2006.01) |

(52) U.S. Cl.
CPC ..... *C22C 45/02* (2013.01); *H01F 3/04* (2013.01); *H01F 3/08* (2013.01); *C22C 2202/02* (2013.01)

(58) Field of Classification Search
USPC ..... 148/304
See application file for complete search history.

(56) References Cited

U.S. PATENT DOCUMENTS

| | | | |
|---|---|---|---|
| 2003/0030407 | A1 | 2/2003 | Maeda |
| 2007/0000294 | A1 | 1/2007 | Umeda |

FOREIGN PATENT DOCUMENTS

| | | |
|---|---|---|
| JP | 2003-050639 | 2/2003 |
| JP | 2005-507061 | 3/2005 |
| JP | 2007-008247 | 1/2007 |
| JP | 2007-538301 | 12/2007 |
| JP | 2011-519098 | 6/2011 |
| WO | 2003/036120 | 5/2003 |
| WO | 2005/073833 | 8/2005 |
| WO | 2009/133056 | 11/2009 |

* cited by examiner

FE-BASED ALLOY COMPOSITION, SOFT MAGNETIC MATERIAL, MAGNETIC MEMBERS, ELECTRIC/ELECTRONIC COMPONENT, AND DEVICE

CLAIM OF PRIORITY

This application is a Continuation of International Application No. PCT/JP2017/006428 filed on Feb. 21, 2017, which claims benefit of Japanese Patent Application No. 2016-043817 filed on Mar. 7, 2016. The entire contents of each application noted above are hereby incorporated by reference.

BACKGROUND OF THE INVENTION

1. Field of the Invention

The present invention relates to Fe-based alloy compositions and particularly relates to an Fe-based alloy composition used as a soft magnetic material. Furthermore, the present invention relates to a soft magnetic material made of the Fe-based alloy composition, a magnetic member containing the soft magnetic material, an electric/electronic component including the magnetic member, and a device including the electric/electronic component.

2. Description of the Related Art

Amorphous phase-containing soft magnetic materials (herein also referred to as "amorphous soft magnetic materials") have been attracting attention as soft magnetic materials having excellent magnetic characteristics.

One of such amorphous soft magnetic materials is a substantially spherical powder formed by a water atomization method using an Fe-based alloy composition. The powder is a non-crystalline soft magnetic alloy powder which mainly contains Fe; which contains at least P, C, and B; and which has a non-crystalline phase with a supercooled-liquid temperature interval (supercooled-liquid region) $\Delta T_x$ of 20 K or more, the supercooled-liquid temperature interval being represented by the equation $\Delta T_x = T_x - T_g$, where $T_x$ represents the crystallization onset temperature and $T_g$ represents the glass transition temperature (Japanese Unexamined Patent Application Publication No. 2004-156134 (hereinafter referred to as the patent document)).

Since the non-crystalline soft magnetic alloy powder (amorphous soft magnetic material) described in the patent document has a glass transition temperature $T_g$, an annealing treatment (in particular, performed by heating for a predetermined time) for removing strain from a magnetic member (a dust core is cited as an example) obtained by working (forming is cited as an example) during working is easy. Therefore, an electric/electronic component (an inductor is cited as an example) including a magnetic member containing an amorphous magnetic material, such as the non-crystalline soft magnetic alloy powder described in the patent document, having a glass transition temperature $T_g$ is likely to have excellent magnetic characteristics. In particular, when the temperature range of the supercooled-liquid region $\Delta T_x$ is wide, the temperature range and heating time range allowed for the annealing treatment are wide and the annealing treatment can be more stably performed.

It has been substantially essential for alloys not containing a transition metal other than Fe to contain P as a metalloid among amorphization elements used to obtain amorphous soft magnetic materials having a glass transition temperature $T_g$. Though P is an excellent amorphization element, P has served as a factor inhibiting the increase of magnetic characteristics, particularly the saturation magnetization Js (unit: T), of obtained amorphous soft magnetic materials in some cases. An amorphous soft magnetic material (herein also referred to as an "Fe-based amorphous soft magnetic material") made of an Fe-based alloy composition is obtained by quenching a melt of an Fe-based alloy composition having a predetermined composition. When P is contained in the melt, it has been difficult to stabilize the composition of the Fe-based alloy composition in the course of producing the amorphous soft magnetic material in some cases because P in the melt is likely to evaporate, P evaporating from the melt has adhered to production apparatuses around the melt to contaminate other steels, or cleaning has took a long time to prevent this to reduce the workability in some cases.

SUMMARY OF THE INVENTION

The present invention provides an Fe-based alloy composition which can form an Fe-based soft magnetic material having a glass transition temperature $T_g$ and which contains substantially no P. The present invention also provides an Fe-based soft magnetic material which contains substantially no P and which has a glass transition temperature $T_g$. Furthermore, the present invention provides a magnetic member containing the Fe-based soft magnetic material having a glass transition temperature $T_g$, an electric/electronic component including the magnetic member, and a device including the electric/electronic component.

The inventors have carried out investigations to solve the above problem and, as a result, have obtained a new finding that even an Fe-based alloy composition which contains B and C as amorphization elements, which contains Si as required, and which contains substantially no P can form an amorphous soft magnetic material having a glass transition temperature $T_g$, although it has been common sense that containing P, which is a non-metal element, as an amorphization element is necessary to obtain an Fe-based amorphous soft magnetic material having a glass transition temperature $T_g$.

The present invention has been completed on the basis of this finding and provides, in an aspect, an Fe-based alloy composition capable of forming a soft magnetic material which has a glass transition temperature $T_g$ and which contains an amorphous phase. The Fe-based alloy composition has a composition represented by the formula $(Fe_{1-a}T_a)_{100at\%-(x+b+c+d)}M_xB_bC_cSi_d$, where T is an arbitrary added element and is one or both of Co and Ni and M is an arbitrary added element and is one or more selected from the group consisting of Ti, V, Cr, Zr, Nb, Mo, Hf, Ta, W, and Al, the formula satisfying the following conditions:

$$0 \le a \le 0.3,$$

$$11.0 \text{ at } \% \le b \le 18.20 \text{ at } \%,$$

$$6.00 \text{ at } \% \le c \le 17 \text{ at } \%,$$

$$0 \text{ at } \% \le d \le 10 \text{ at } \%, \text{ and}$$

$$0 \text{ at } \% \le x \le 4 \text{ at } \%.$$

The Fe-based alloy composition, which has such a composition, can form a soft magnetic material which has a glass transition temperature $T_g$ and which contains an amorphous phase, although the Fe-based alloy composition is substantially undoped with P.

In the formula, when R=(b+c)/[(1−a)×{100 at %−(x+b+c+d)}], it is preferable that 0.25≤R≤0.429 in some cases.

In the formula, 100 at %−(x+b+c+d) is preferably 67.20 at % to 80.00 at % in some cases.

In the formula, b is preferably 11.52 at % to 18.14 at % in some cases.

In the formula, c is preferably 6.00 at % to 16.32 at % in some cases.

In the formula, d is preferably more than 0 at % to 10 at % in some cases.

In the formula, M preferably includes Cr in some cases. In particular, when a method for forming a soft magnetic material from the Fe-based alloy composition is a method, such as a water atomization method, using water, Cr is preferably contained from the viewpoint of the increase in corrosion resistance of the obtained soft magnetic material. When M includes Cr, the content of Cr is preferably 0 at % to 4 at % in some cases and is more preferably 0 at % to 3 at % in some cases.

The present invention provides, in another aspect, an Fe-based alloy composition capable of forming a soft magnetic material which has a glass transition temperature $T_g$ and which contains an amorphous phase. The Fe-based alloy composition has a composition represented by the formula $(Fe_{1-a}T_a)_{100at\,\%-(x+b+c+d)}M_xB_bC_cSi_d$, where T is an arbitrary added element and is one or both of Co and Ni and M is an arbitrary added element and is one or more selected from the group consisting of Ti, V, Cr, Zr, Nb, Mo, Hf, Ta, W, and Al, the formula satisfying the following conditions:

$0 \le a \le 0.3$, 11.0 at % $\le b \le$ 20.0 at %, 1.5 at % $\le c \le$ 6 at %, 0 at % $< d \le$ 10 at %, 0 at % $\le x \le$ 4 at %, and $0.25 \le R \le 0.32$, where R=(b+c)/[(1−a)×{100 at %−(x+b+c+d)}].

The Fe-based alloy composition can form a soft magnetic material which has a glass transition temperature $T_g$ and which contains an amorphous phase, although the Fe-based alloy composition is undoped with P and the content c of C therein is less than 6.00 at %.

In the formula, b is preferably 15.0 at % to 19.0 at % in some cases.

It is preferable that R is 0.25 to 0.30 in some cases.

The present invention provides, in another aspect, a soft magnetic material having the composition of the Fe-based alloy composition. The soft magnetic material has a glass transition temperature $T_g$ and contains an amorphous phase.

The soft magnetic material may be ribbon-shaped or wire-shaped or may be in a powder form.

As the supercooled-liquid region $\Delta T_x$ defined by the temperature difference $(T_x-T_g)$ between the crystallization onset temperature $T_x$ and glass transition temperature $T_g$ of the soft magnetic material is larger, amorphous formability is expected to be higher. The supercooled-liquid region $\Delta T_x$ is preferably 25° C. or more in some cases and is more preferably 40° C. or more in some cases.

From the viewpoint of facilitating the increase in guaranteed operating temperature of a magnetic member containing the soft magnetic material, the Curie temperature $T_c$ is preferably 340° C. or more in some cases.

In the case where the soft magnetic material is heated to a temperature higher than the crystallization onset temperature $T_x$ thereof and is crystallized and the crystallized soft magnetic material is measured by X-ray diffraction, an X-ray diffraction spectrum having a peak assigned to α-Fe and at least one of a peak assigned to $Fe_3B$ and a peak assigned to $Fe_3(B_yC_{1-y})$ (y is 0 to less than 1) is preferably obtained in some cases.

The present invention provides, in another aspect, a magnetic member containing the soft magnetic material. The magnetic member may be a magnetic core or a magnetic sheet.

The present invention provides, in another aspect, an electric/electronic component including the magnetic member.

The present invention provides, in another aspect, a device including the electric/electronic component.

DESCRIPTION OF THE PREFERRED EMBODIMENTS

Figure 1:
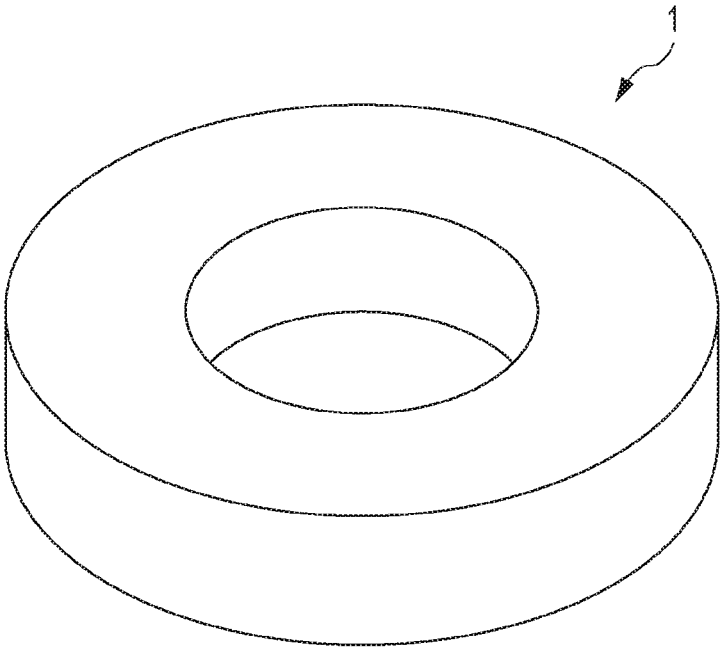
FIG. 1 is a schematic perspective view of a toroidal core which is an example of a magnetic core according to an embodiment of the present invention.

Embodiments of the present invention will now be described in detail.

An Fe-based alloy composition according to a first embodiment of the present invention can form an amorphous soft magnetic material (amorphous phase-containing soft magnetic material) having a glass transition temperature $T_g$ and has a composition represented by the formula $(Fe_{1-a}T_a)_{100at\%-(x+b+c+d)}M_xB_bC_cSi_d$, where T is an arbitrary added element and is one or both of Co and Ni and M is an arbitrary added element and is one or more selected from the group consisting of Ti, V, Cr, Zr, Nb, Mo, Hf, Ta, W, and Al. The formula satisfies the following inequalities:

$0 \leq a \leq 0.3$, 11.0 at % $\leq b \leq$ 18.20 at %, 6.00 at % $\leq c \leq$ 17 at %, 0 at % $\leq d \leq$ 10 at %, and 0 at % $\leq x \leq$ 4 at %.

The Fe-based alloy composition is undoped with P and contains substantially no P. Components of the Fe-based alloy composition are described below. The Fe-based alloy composition may contain inevitable impurities in addition to components below.

B has excellent amorphous formability. Thus, the content b of B in the Fe-based alloy composition is 11.0 at % or more. However, when an excessive amount of B is contained in the Fe-based alloy composition, an alloy has an increased melting point and amorphous formation is difficult in some cases. Thus, the content b of B in the Fe-based alloy composition is 25 at % or less in some cases or 18.20 at % or less in some cases. From the viewpoint of stably enhancing magnetic characteristics of an Fe-based amorphous soft magnetic material formed from the Fe-based alloy composition, the content b of B in the Fe-based alloy composition is preferably 10 at % to 25 at %, more preferably 10.5 at % to 15 at %, and further more preferably 11.81 at % to 14.59 at %.

When the content b of B in the Fe-based alloy composition is 11.52 at % to 18.14 at %, an amorphous soft magnetic material which has a glass transition temperature $T_g$ and which contains an amorphous phase is likely to be obtained. When the content b of B in the Fe-based alloy composition is 12.96 at % to 18.14 at %, preferably 14 at % to 17 at %, an amorphous soft magnetic material which exhibits a clear glass transition and which contains an amorphous phase is likely to be obtained.

C increases the thermal stability of the Fe-based alloy composition and has excellent amorphous formability. Thus, the content c of C in the Fe-based alloy composition is 6.00 at % or more. However, when an excessive amount of C is contained in the Fe-based alloy composition, alloying is difficult in some cases. Thus, the content c of C in the Fe-based alloy composition is 15 at % or less in some cases or 17 at % or less in some cases. From the viewpoint of reducing the melting point, the content c of C in the Fe-based alloy composition is preferably 6.00 at % to 10 at %, more preferably 6.00 at % to 9.0 at %, and further more preferably 6.02 at % to 8.16 at %. When the content c of C in the Fe-based alloy composition is 16.32 at % or less, an amorphous soft magnetic material which has a glass transition temperature $T_g$ and which contains an amorphous phase is likely to be obtained. When the content c of C in the Fe-based alloy composition is 15 at % or less, preferably 14.5 at %, or more preferably 14.40 at % or less, an amorphous soft magnetic material which exhibits a clear glass transition and which contains an amorphous phase is likely to be obtained.

In the composition of the Fe-based alloy composition, the ratio of the sum of the contents of B and C to the content of Fe (hereinafter also referred to as the "BC/Fe ratio") is preferably from 0.25 to 0.429. Since the BC/Fe ratio, which is the ratio of the sum of the contents of B and C which are main amorphization elements to the content of Fe which is a fundamental element in the Fe-based alloy composition, is relatively high (in particular, the BC/Fe ratio is 0.25 or more), an amorphous phase-containing soft magnetic material (amorphous soft magnetic material) may possibly be readily formed from the Fe-based alloy composition.

From the viewpoint of stably obtaining an amorphous soft magnetic material, the BC/Fe ratio is preferably 0.261 or more, more preferably 0.282 or more, and further more preferably 0.333 or more. On the other hand, from the viewpoint of increasing the saturation magnetization Js of the amorphous soft magnetic material, it is advantageous that the BC/Fe ratio is small. In particular, the BC/Fe ratio is preferably 0.370 or less, more preferably 0.333 or less, and further more preferably 0.282 or less.

From the above, in consideration of the balance between stably obtaining the amorphous soft magnetic material and obtaining high saturation magnetization Js, the BC/Fe ratio is preferably from 0.261 to 0.370, more preferably from 0.261 to 0.333, and further more preferably from 0.282 to 0.333.

Si increases the thermal stability of the Fe-based alloy composition and has excellent amorphous formability. Increasing the content d of Si in the Fe-based alloy composition allows the crystallization onset temperature $T_x$ of an Fe-based amorphous soft magnetic material formed from the Fe-based alloy composition to be increased more preferentially than the glass transition temperature $T_g$ thereof, thereby enabling the supercooled-liquid region $\Delta T_x$ to be expanded. Increasing the content d of Si in the Fe-based alloy composition enables the Curie temperature $T_c$ of the Fe-based amorphous soft magnetic material formed from the Fe-based alloy composition to be increased. Furthermore, increasing the content d of Si in the Fe-based alloy composition allows the melting point of the Fe-based alloy composition to be reduced, thereby enabling workability using a melt thereof to be enhanced. Thus, the Fe-based alloy composition may contain Si.

However, when an excessive amount of Si is contained in the Fe-based alloy composition, the Fe-based amorphous soft magnetic material formed from the Fe-based alloy composition has a significantly increased glass transition temperature $T_g$ and it is difficult to expand the supercooled-liquid region $\Delta T_x$. Furthermore, when an excessive amount of Si is contained in the Fe-based alloy composition, the reduction in saturation magnetization Js of the Fe-based amorphous soft magnetic material formed from the Fe-based alloy composition tends to be significant in some cases. Thus, the content d of Si in the Fe-based alloy composition is 12 at % or less. From the viewpoint of stably achieving the improvement of thermal characteristics and magnetic characteristics of the Fe-based amorphous soft magnetic material formed from the Fe-based alloy composition, the content d of Si in the Fe-based alloy composition is preferably more than 0 at % to 10 at %, more preferably 1.0 at % to 8.0 at %, and further more preferably 2 at % to 6.0 at %.

The Fe-based alloy composition may contain an element (arbitrary added element) T including one or both of Co and Ni. Co and Ni, as well as Fe, are elements exhibiting ferromagnetic properties at room temperature. Partially substituting Fe with one or both of Co and Ni enables magnetic characteristics of the Fe-based amorphous soft magnetic material formed from the Fe-based alloy composition to be adjusted. About three-tenth or less of the content (unit: at %) of Fe is preferably substituted with the element T. When the element T is Co, substituting about two-tenth of the content (unit: at %) of Fe with Co increases the saturation magnetization Js. However, it is not preferable to heavily substitute Fe with Co because Co is expensive. When the element T is Ni, increasing the substitution amount reduces the melting point and therefore is preferable; however, excessively increasing the substitution amount reduces the saturation magnetization Js and therefore is not preferable. From this viewpoint, the substitution amount of the element T is preferably two-tenth or less of the content (unit: at %) of Fe.

The Fe-based alloy composition may contain an arbitrary added element M including one or more selected from the group consisting of Ti, V, Cr, Zr, Nb, Mo, Hf, Ta, W, and Al. These elements function as substitution elements for Fe or function as amorphization elements. When the content x of the arbitrary added element M in the Fe-based alloy composition is excessively high, the content of another element (C, B, Si, or the like) and the content of Fe are relatively low; hence, an advantage due to the addition of these elements is unlikely to be obtained. With this in mind, the upper limit of the content x of the arbitrary added element M is 4 at % or less.

Cr, which is an example of the arbitrary added element M, can increase the corrosion resistance of the Fe-based amorphous soft magnetic material formed from the Fe-based alloy composition. Thus, when the Fe-based alloy composition contains Cr, the content of Cr is preferably 0.5 at % or more. When the content of Cr in the Fe-based alloy composition is up to about 4 at %, the influence of the content of Cr on the supercooled-liquid region $\Delta T_x$ of the Fe-based amorphous soft magnetic material formed from the Fe-based alloy composition is slight. Therefore, when the Fe-based alloy composition contains Cr, the content of Cr is preferably 4 at % or less, more preferably 3 at % or less, and further more preferably 2.88 at % or less.

In an Fe-based alloy composition according to a second embodiment of the present invention, adjusting the BC/Fe ratio to 0.25 or more enables the content c of Cr to be reduced to less than 6.00 at %.

That is, the Fe-based alloy composition according to the second embodiment can form an amorphous soft magnetic material (amorphous phase-containing soft magnetic material) having a glass transition temperature $T_g$ and has a composition represented by the formula $(Fe_{1-a}T_a)_{100at\,\%-(x+b+c+d)}M_xB_bC_cSi_d$, where T is an arbitrary added element and is one or both of Co and Ni and M is an arbitrary added element and is one or more selected from the group consisting of Ti, V, Cr, Zr, Nb, Mo, Hf, Ta, W, and Al. The formula may satisfy the following inequalities:

$$11.0\text{ at }\% \le b \le 20.0\text{ at }\%,$$

$$1.5\text{ at }\% \le c < 6\text{ at }\%,$$

$$0\text{ at }\% < d \le 10\text{ at }\%,$$

$$0\text{ at }\% \le x \le 4\text{ at }\%, \text{ and}$$

$$0.25 \le R \le 0.32,$$

where $R=(b+c)/[(1-a)\times\{100\text{ at }\%-(x+b+c+d)\}]$ and R is the BC/Fe ratio.

The Fe-based alloy composition according to the second embodiment is undoped with P and contains substantially no P.

Since the BC/Fe ratio is 0.25 or more, an amorphous phase-containing soft magnetic material (amorphous soft magnetic material) may possibly be readily formed from the Fe-based alloy composition according to the second embodiment. From the viewpoint of stably obtaining the amorphous soft magnetic material, the BC/Fe ratio is preferably 0.25 or more, more preferably 0.26 or more, further more preferably 0.261 or more, and particularly preferably 0.266 or more. However, from the viewpoint of increasing the saturation magnetization Js of the amorphous soft magnetic material, it is advantageous that the BC/Fe ratio is small. In particular, the BC/Fe ratio is preferably 0.30 or less, more preferably 0.29 or less, and further more preferably 0.290 or less.

From the above, in consideration of the balance between stably obtaining the amorphous soft magnetic material and obtaining high saturation magnetization Js, the BC/Fe ratio is preferably from 0.25 to 0.30, more preferably from 0.26 to 0.29, further more preferably from 0.261 to 0.290, and particularly preferably from 0.266 to 0.290.

In consideration of a variation in melting point and from the viewpoint of allowing B to appropriately exhibit amorphous formability, the content b of B in the Fe-based alloy composition according to the second embodiment is 11.0 at % to 20.0 at %. When the content b of B is 15.0 at % to 19.0 at %, an amorphous phase-containing amorphous soft magnetic material having a glass transition temperature $T_g$ is likely to be obtained. When the content b of B is 15.5 at % to 18.0 at %, preferably 15.84 at % to 17.28 at %, an amorphous phase-containing amorphous soft magnetic material exhibiting a clear glass transition is likely to be obtained. Incidentally, it is essential for the Fe-based alloy composition according to the second embodiment to contain Si (that is, the content d of Si is more than 0 at %). The range of the content of an element other than B and C is substantially the same as that in the Fe-based alloy composition according to the first embodiment and therefore is not described in detail.

A soft magnetic material according to a third embodiment of the present invention is an amorphous soft magnetic material which has the composition of the Fe-based alloy composition according to the first or second embodiment, which contains substantially no P, which has a glass transition temperature $T_g$, and which contains an amorphous phase. An amorphous phase in the soft magnetic material according to the third embodiment is preferably a primary phase of a soft magnetic material. The term "primary phase" as used herein refers to a phase having the highest volume fraction in the microstructure of a soft magnetic material. The soft magnetic material according to the third embodiment is preferably composed substantially of an amorphous phase. The expression "composed substantially of an amorphous phase" as used herein means that no distinct peak is observed in an X-ray diffraction spectrum obtained by measuring a soft magnetic material by X-ray diffraction.

A method for producing the soft magnetic material according to the third embodiment from the Fe-based alloy composition according to the first or second embodiment is not particularly limited. From the viewpoint of readily obtaining a soft magnetic material in which a primary phase is amorphous or a soft magnetic material which is composed substantially of an amorphous phase, a ribbon-quenching method such as a single-roll method or a twin-roll method, an atomization method such as a gas atomization method or a water atomization method, or the like is preferably used.

In the case of using the ribbon-quenching method to produce the soft magnetic material according to the third embodiment, an obtained soft magnetic material is strip-shaped. A powdery soft magnetic material can be obtained by crushing the strip-shaped soft magnetic material. In the case of using the atomization method to produce the soft magnetic material according to the third embodiment, an obtained soft magnetic material is powdery.

Herein, the Curie temperature $T_c$, glass transition temperature $T_g$, and crystallization onset temperature $T_x$, which are thermophysical parameters, of a soft magnetic material are set on the basis of a DSC chart obtained by measuring the soft magnetic material at a heating rate of 40° C./min by differential scanning calorimetry (a measurement system, STA449/A23 Jupiter, available from NETZSCH-Geratebau GmbH is exemplified). The supercooled-liquid region $\Delta T_x$ is calculated from the glass transition temperature $T_g$ and the crystallization onset temperature T.

From the viewpoint of readily heat-treating magnetic members containing the soft magnetic material according to the third embodiment, the crystallization onset temperature $T_x$ of the soft magnetic material according to the third embodiment is preferably 25° C. or more, more preferably 35° C. or more, and further more preferably 45° C. or more.

The Curie temperature $T_c$ of the soft magnetic material according to the third embodiment is preferably 340° C. or more. An Fe-based alloy composition giving the soft magnetic material according to the third embodiment contains substantially no P as described above. Since P is a factor reducing the saturation magnetization Js, the soft magnetic material according to the third embodiment tends to have high saturation magnetization Js. Therefore, the Curie temperature $T_c$, at which magnetization is substantially lost, is likely to be high. The fact that the Curie temperature $T_c$ is high leads to the increase in guaranteed operating temperature of electric/electronic components including a magnetic member containing the soft magnetic material according to the third embodiment and is therefore preferable.

Heating the soft magnetic material according to the third embodiment to a temperature exceeding the crystallization onset temperature $T_x$ induces crystallization in the soft magnetic material according to the third embodiment. Measuring a crystalline soft magnetic material obtained in such a manner by X-ray diffraction allows an X-ray diffraction spectrum having a peak assigned to α-Fe to be obtained. Since the soft magnetic material according to the third embodiment contains B and C as amorphization elements, the X-ray diffraction spectrum preferably has at least one of a peak assigned to $Fe_3B$ and a peak assigned to $Fe_3(B_yC_{1-y})$ (where y is 0 to less than 1 and is typically 0.7). When an amorphous phase in a soft magnetic material is converted into a crystalline phase by heating, a crystal (α-Fe is cited as an example) made of Fe, which is a primary element, is relatively readily formed and a crystal containing multiple elements as described above is more unlikely to be formed as compared to the crystal made of Fe in some cases. Therefore, it is expected that the transition from an amorphous phase to a crystalline phase is relatively unlikely to occur and crystalline matter is unlikely to be produced during annealing. As an example of a crystalline phase, $Fe_{23}B_6$ is cited. The above X-ray diffraction spectrum may have a peak assigned to $Fe_{23}B_6$.

A magnetic member according to a fourth embodiment of the present invention contains the soft magnetic material according to the third embodiment. The detailed form of the magnetic member according to the fourth embodiment is not particularly limited. The magnetic member according to the fourth embodiment may be a magnetic core obtained by compacting a powder material containing the soft magnetic material according to the third embodiment. FIG. 1 shows a toroidal core 1 which is an example of such a magnetic core and which is ring-shaped. Another example of the detailed form of the magnetic member according to the fourth embodiment is a magnetic sheet obtained by forming a slurry composition containing the soft magnetic material according to the third embodiment into a sheet.

Accumulating strain in a soft magnetic material in a magnetic member by a soft magnetic material-preparing step (for example, crushing) or a magnetic member-manufacturing step (for example, compacting) may possibly reduce magnetic characteristics (core loss, direct-current superposition characteristics, and the like are cited as examples) of an electric/electronic component including the magnetic member. In this case, the reduction in magnetic characteristics of the electric/electronic component including the magnetic member is generally suppressed in such a manner that the stress based on the strain in the soft magnetic material is relieved by annealing the magnetic member.

The magnetic member according to the fourth embodiment can be readily annealed because the soft magnetic material contained in the magnetic member according to the fourth embodiment has a glass transition temperature $T_g$ and the supercooled-liquid region $\Delta T_x$ in a preferable example is 25° C. or more. Thus, an electric/electronic component including the magnetic member according to the fourth embodiment can have excellent magnetic characteristics. Examples of such an electric/electronic component according to a fifth embodiment of the present invention include inductors, motors, transformers, and electromagnetic interference-suppressing members.

A device according to a sixth embodiment of the present invention includes the electric/electronic component according to the fifth embodiment. Examples of the device include portable electronic devices such as smartphones, notebook personal computers, and tablet terminals; electronic calculators such as personal computers and servers; transportation machines such as automobiles and motorcycles; and electric machines such as power generation units, transformers, and power storage units.

The embodiments described above are intended to facilitate the understanding of the present invention and are not intended to limit the present invention. Thus, the elements disclosed in the embodiments are intended to include all design modifications and equivalents that belong to the technical scope of the present invention.

EXAMPLES

The present invention is further described below in detail with reference to examples. The present invention is not limited to the examples.

Fe-based alloy compositions having a composition shown in Tables 1 to 3 were produced and were then formed into ribbons. Soft magnetic materials were prepared from the ribbons by a single-roll method. The ribbons had a thickness of about 20 μm. The ribbons were measured by X-ray diffraction using a Cu Kα radiation source, resulting in that any peak showing the presence of crystalline matter was not observed in all X-ray diffraction spectra and it was confirmed that all the ribbons were made of an amorphous phase. In Tables 1 to 3, "A" in the column "Structure" means an amorphous phase. In Tables 1 to 3, the value of the BC/Fe ratio is given in the column "(B+C)/Fe".

TABLE 1

| | Composition | | | | | |
|---|---|---|---|---|---|---|
| | at % | | | | (B + C)/ | |
| | Fe | B | C | Si | Fe | Structure |
| Example 1 | 80.60 | 14.80 | 4.60 | 0.00 | 0.241 | A |
| Example 2 | 77.38 | 14.21 | 4.42 | 4.00 | 0.241 | A |
| Example 3 | 80.00 | 13.80 | 6.20 | 0.00 | 0.250 | A |
| Example 4 | 76.80 | 13.25 | 5.95 | 4.00 | 0.250 | A |
| Example 5 | 80.00 | 12.60 | 7.40 | 0.00 | 0.250 | A |
| Example 6 | 76.80 | 12.10 | 7.10 | 4.00 | 0.250 | A |
| Example 7 | 79.40 | 10.80 | 9.80 | 0.00 | 0.259 | A |
| Example 8 | 76.22 | 10.37 | 9.41 | 4.00 | 0.259 | A |
| Example 9 | 79.30 | 14.30 | 6.40 | 0.00 | 0.261 | A |
| Example 10 | 78.51 | 14.16 | 6.34 | 1.00 | 0.261 | A |
| Example 11 | 77.71 | 14.01 | 6.27 | 2.00 | 0.261 | A |
| Example 12 | 76.92 | 13.87 | 6.21 | 3.00 | 0.261 | A |
| Example 13 | 76.13 | 13.73 | 6.14 | 4.00 | 0.261 | A |
| Example 14 | 75.34 | 13.59 | 6.08 | 5.00 | 0.261 | A |
| Example 15 | 74.54 | 13.44 | 6.02 | 6.00 | 0.261 | A |
| Example 16 | 79.30 | 12.30 | 8.40 | 0.00 | 0.261 | A |
| Example 17 | 76.13 | 11.81 | 8.06 | 4.00 | 0.261 | A |
| Example 18 | 79.00 | 13.30 | 7.70 | 0.00 | 0.266 | A |
| Example 19 | 75.84 | 12.77 | 7.39 | 4.00 | 0.266 | A |
| Example 20 | 78.00 | 15.20 | 6.80 | 0.00 | 0.282 | A |
| Example 21 | 74.88 | 14.59 | 6.53 | 4.00 | 0.282 | A |
| Example 22 | 78.00 | 13.90 | 8.10 | 0.00 | 0.282 | A |
| Example 23 | 74.88 | 13.34 | 7.78 | 4.00 | 0.282 | A |
| Example 24 | 76.70 | 14.80 | 8.50 | 0.00 | 0.304 | A |
| Example 25 | 73.63 | 14.21 | 8.16 | 4.00 | 0.304 | A |

TABLE 2

| | Composition | | | | | |
|---|---|---|---|---|---|---|
| | at % | | | | (B + C)/ | |
| | Fe | B | C | Si | Fe | Structure |
| Example 30 | 75.84 | 16.32 | 3.84 | 4.00 | 0.266 | A |
| Example 31 | 74.88 | 11.52 | 9.60 | 4.00 | 0.282 | A |
| Example 32 | 73.63 | 10.56 | 11.81 | 4.00 | 0.304 | A |
| Example 33 | 72.96 | 16.32 | 6.72 | 4.00 | 0.316 | A |
| Example 34 | 72.00 | 21.12 | 2.88 | 4.00 | 0.333 | A |
| Example 35 | 72.00 | 19.20 | 4.80 | 4.00 | 0.333 | A |
| Example 36 | 72.00 | 17.28 | 6.72 | 4.00 | 0.333 | A |
| Example 37 | 72.00 | 14.40 | 9.60 | 4.00 | 0.333 | A |
| Example 38 | 70.08 | 20.16 | 5.76 | 4.00 | 0.370 | A |
| Example 39 | 70.08 | 16.42 | 9.50 | 4.00 | 0.370 | A |
| Example 40 | 70.08 | 14.40 | 11.52 | 4.00 | 0.370 | A |
| Example 41 | 67.20 | 20.16 | 8.64 | 4.00 | 0.429 | A |
| Example 42 | 67.20 | 18.14 | 10.66 | 4.00 | 0.429 | A |
| Example 43 | 67.20 | 16.32 | 12.48 | 4.00 | 0.429 | A |
| Example 44 | 72.96 | 13.16 | 5.89 | 8.00 | 0.261 | A |
| Example 45 | 71.37 | 12.87 | 5.76 | 10.00 | 0.261 | A |
| Example 46 | 69.78 | 12.58 | 5.63 | 12.00 | 0.261 | A |
| Example 47 | 74.88 | 19.20 | 1.92 | 4.00 | 0.282 | A |
| Example 48 | 74.88 | 15.84 | 5.28 | 4.00 | 0.282 | A |
| Example 49 | 74.40 | 17.28 | 4.32 | 4.00 | 0.290 | A |
| Example 50 | 72.00 | 12.96 | 11.04 | 4.00 | 0.333 | A |
| Example 51 | 70.08 | 18.24 | 7.68 | 4.00 | 0.370 | A |
| Example 52 | 70.08 | 12.48 | 13.44 | 4.00 | 0.370 | A |
| Example 53 | 67.20 | 14.40 | 14.40 | 4.00 | 0.429 | A |
| Example 54 | 67.20 | 12.48 | 16.32 | 4.00 | 0.429 | A |
| Example 55 | 67.00 | 15.00 | 6.00 | 12.00 | 0.313 | A |
| Example 56 | 65.00 | 25.00 | 6.00 | 4.00 | 0.477 | A |

TABLE 3

| | Composition | | | | | | |
|---|---|---|---|---|---|---|---|
| | at % | | | | | (B + C)/ | |
| | Fe | Cr | B | C | Si | Fe | Structure |
| Example 26 | 76.13 | 0.00 | 13.73 | 6.14 | 4.00 | 0.261 | A |
| Example 27 | 75.17 | 0.96 | 13.73 | 6.14 | 4.00 | 0.264 | A |
| Example 28 | 74.21 | 1.92 | 13.73 | 6.14 | 4.00 | 0.268 | A |
| Example 29 | 73.25 | 2.88 | 13.73 | 6.14 | 4.00 | 0.271 | A |

Each ribbon was measured for Curie temperature $T_c$ (unit: ° C.), glass transition temperature $T_g$ (unit: ° C.), crystallization onset temperature $T_x$ (unit: ° C.), and melting point $T_m$ (unit: ° C.) using a differential scanning calorimeter. On the basis of a DSC chart thereby obtained, the supercooled-liquid region $\Delta T_x$ (unit: ° C.) was calculated. The results were shown in Tables 4 to 6. Furthermore, the density of the ribbon was measured. The density thereof was calculated from the density of an alloy composition shown in FIG. 9 of F. E. Luborsky, J. J. Becker, J. L. Walter, D. L. Martin, "The Fe—BC Ternary Amorphous Alloys", IEEE Transactions on Magnetics, MAG-16 (1980) 521. The results were also shown in Tables 4 to 6.

Figure 2A:
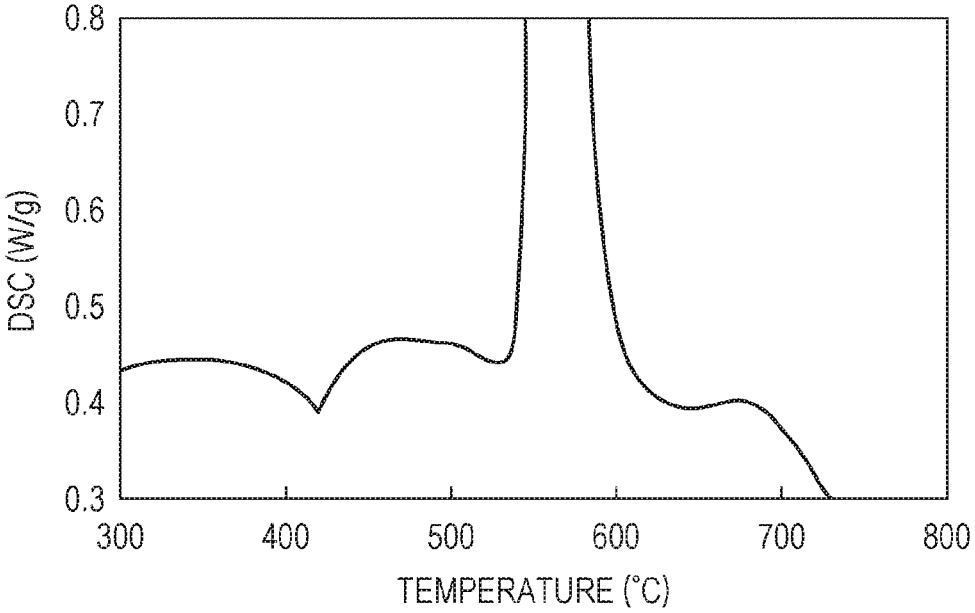
FIG. 2A is a DSC chart of an Fe-based alloy composition, prepared in Example 13, having a glass transition temperature $T_g$.
Figure 2B:
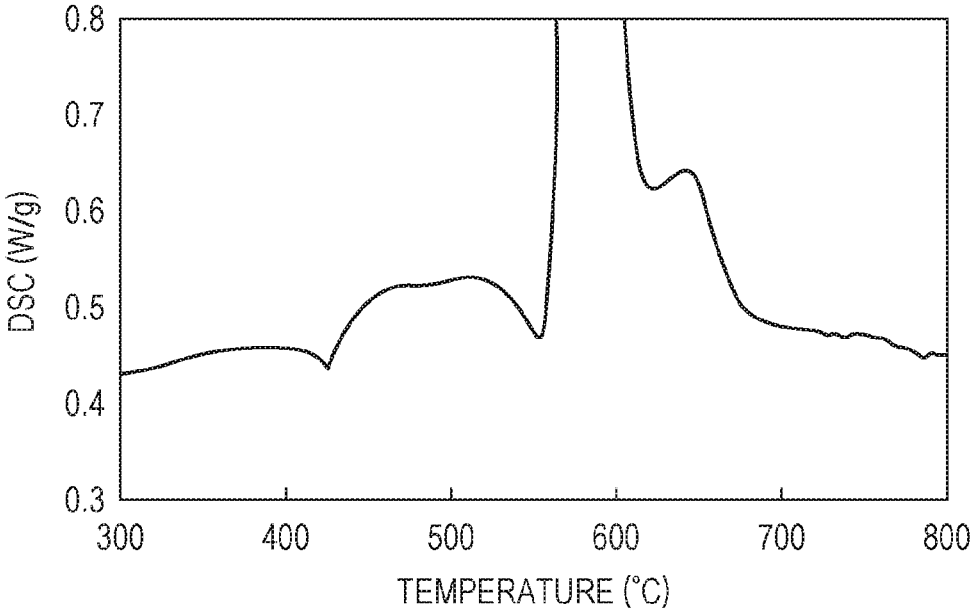
FIG. 2B is a DSC chart of an Fe-based alloy composition, prepared in Example 25, having a glass transition temperature $T_g$.

A DSC chart of an Fe-based alloy composition, prepared in Example 13, having a glass transition temperature $T_g$ was shown in FIG. 2A. A DSC chart of an Fe-based alloy composition, prepared in Example 25, having a glass transition temperature $T_g$ was shown in FIG. 2B. A DSC chart of an Fe-based alloy composition, prepared in Example 3, having no glass transition temperature $T_g$ was shown in FIG. 3. As shown in FIG. 2A, in the DSC chart of the Fe-based alloy composition prepared in Example 13, an endothermic peak was observed in a range from the Curie temperature $T_c$ (420° C.) to the crystallization onset temperature $T_x$ (540° C.), particularly a range from about 500° C. to about 540° C. As shown in FIG. 2B, in the DSC chart of the Fe-based alloy composition prepared in Example 25, a clear endothermic peak was observed in a range from the Curie temperature $T_c$ (426° C.) to the crystallization onset temperature $T_x$ (560° C.), particularly a range from about 520° C. to about 560° C. Herein, the case where such an endothermic peak as shown in FIG. 2B is clearly observed in a DSC chart like Example 25 is expressed as a glass transition clearly measured in some cases.

Figure 3:
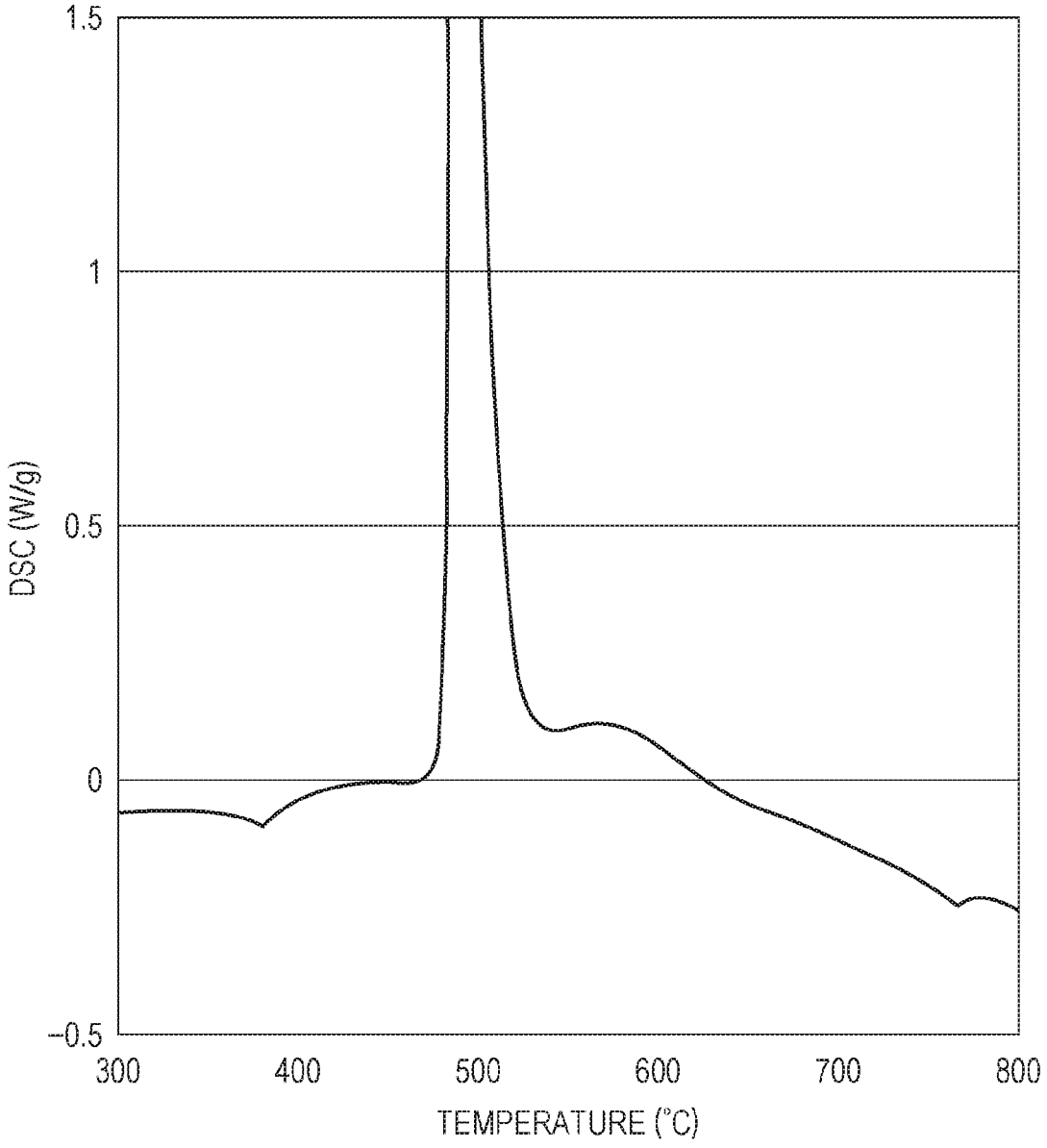
FIG. 3 is a DSC chart of an Fe-based alloy composition, prepared in Example 3, having no glass transition temperature $T_g$.

As shown in FIG. 3, in the DSC chart of the Fe-based alloy composition prepared in Example 3, it was confirmed that no endothermic peak was observed in a range from the Curie temperature $T_c$ (380° C.) to the crystallization onset temperature $T_x$ (480° C.).

In Tables 4 to 6, judgement results based on these DSC charts were shown in the column "Metallic glass". That is, in the case where no endothermic peak was observed, metallic glass was judged absent and "A" was given in the column "Metallic glass". In the case where an endothermic peak was observed and was particularly large (in particular, in the case where a glass transition was clearly observed like Example 25), a property of metallic glass was judged clear and "C" was given in the column "Metallic glass". In the case where an endothermic peak was observed and was not enough to give "C" (in particular, a case like Example 13), metallic glass was judged present and "B" was given in the column "Metallic glass".

TABLE 4

| | Melting point $T_m$ (° C.) | Crystallization temperature $T_x$ (° C.) | Glass transition temperature $T_g$ (° C.) | Supercooled-liquid region $\Delta T_x$ (° C.) | Curie temperature $T_c$ (° C.) | Saturation magnetization $J_s$ (T) | Density ρ (g/cm$^3$) | Metallic glass | Remarks on Example |
|---|---|---|---|---|---|---|---|---|---|
| Example 1 | 1163 | 478 | | | 369 | 1.67 | 7.45 | A | Comparative |
| Example 2 | 1171 | 533 | | | 416 | 1.62 | 7.45 | A | Comparative |
| Example 3 | 1172 | 480 | | | 380 | 1.66 | 7.47 | A | Comparative |
| Example 4 | 1192 | 538 | | | 417 | 1.62 | 7.47 | A | Comparative |
| Example 5 | 1154 | 481 | 460 | 21 | 373 | 1.68 | 7.48 | B | Inventive |
| Example 6 | 1181 | 530 | 474 | 56 | 412 | 1.59 | 7.48 | B | Inventive |
| Example 7 | 1146 | 485 | | | 376 | 1.66 | 7.48 | A | Comparative |
| Example 8 | 1162 | 535 | | | 407 | 1.57 | 7.48 | A | Comparative |
| Example 9 | 1171 | 489 | 464 | 25 | 384 | 1.65 | 7.45 | B | Inventive |
| Example 10 | 1200 | 499 | 470 | 29 | 398 | 1.65 | 7.45 | B | Inventive |
| Example 11 | 1201 | 512 | 471 | 41 | 407 | 1.64 | 7.45 | B | Inventive |
| Example 12 | 1178 | 527 | 473 | 54 | 415 | 1.62 | 7.45 | B | Inventive |
| Example 13 | 1133 | 540 | 483 | 57 | 420 | 1.59 | 7.45 | B | Inventive |
| Example 14 | 1089 | 550 | 483 | 67 | 424 | 1.58 | 7.45 | B | Inventive |
| Example 15 | 1088 | 556 | 510 | 46 | 428 | 1.56 | 7.45 | B | Inventive |
| Example 16 | 1150 | 488 | | | 379 | 1.66 | 7.48 | A | Comparative |
| Example 17 | 1185 | 538 | 511 | 27 | 414 | 1.60 | 7.48 | B | Inventive |
| Example 18 | 1178 | 492 | 475 | 17 | 387 | 1.65 | 7.45 | B | Inventive |
| Example 19 | 1174 | 540 | 506 | 34 | 419 | 1.56 | 7.45 | B | Inventive |
| Example 20 | 1172 | 470 | | | 402 | 1.63 | 7.40 | A | Comparative |
| Example 21 | 1161 | 555 | 526 | 29 | 429 | 1.58 | 7.40 | C | Inventive |
| Example 22 | 1178 | 488 | 470 | 18 | 398 | 1.64 | 7.44 | B | Inventive |
| Example 23 | 1177 | 550 | 520 | 30 | 423 | 1.55 | 7.44 | B | Inventive |
| Example 24 | 1206 | 500 | | | 410 | 1.60 | 7.37 | A | Comparative |
| Example 25 | 1151 | 560 | 526 | 34 | 426 | 1.56 | 7.37 | C | Inventive |

TABLE 5

| | Melting point $T_m$ (° C.) | Crystallization temperature $T_x$ (° C.) | Glass transition temperature $T_g$ (° C.) | Supercooled-liquid region $\Delta T_x$ (° C.) | Curie temperature $T_c$ (° C.) | Saturation magnetization $J_s$ (T) | Density ρ (g/cm$^3$) | Metallic glass | Remarks on Example |
|---|---|---|---|---|---|---|---|---|---|
| Example 30 | 1113 | 545 | 520 | 25 | 434 | 1.59 | 7.41 | C | Inventive |
| Example 31 | 1176 | 546 | 521 | 25 | 415 | 1.56 | 7.47 | B | Inventive |
| Example 32 | 1157 | 552 | | | 409 | 1.52 | 7.45 | A | Comparative |
| Example 33 | 1119 | 568 | 543 | 25 | 438 | 1.52 | 7.33 | C | Inventive |
| Example 34 | 1122 | 550 | | | 456 | 1.5 | 7.23 | A | Comparative |
| Example 35 | 1101 | 558 | | | 450 | 1.47 | 7.25 | A | Comparative |
| Example 36 | 1114 | 572 | 544 | 28 | 440 | 1.47 | 7.27 | B | Inventive |
| Example 37 | 1133 | 575 | 548 | 27 | 421 | 1.45 | 7.31 | C | Inventive |
| Example 38 | 1302 | 560 | | | 447 | 1.44 | 7.18 | A | Comparative |
| Example 39 | 1119 | 581 | 554 | 27 | 427 | 1.42 | 7.23 | C | Inventive |
| Example 40 | 1118 | 579 | 552 | 27 | 422 | 1.43 | 7.25 | C | Inventive |
| Example 41 | 1298 | 592 | | | 422 | 1.33 | 7.1 | A | Comparative |
| Example 42 | 1297 | 595 | 567 | 28 | 419 | 1.35 | 7.12 | C | Inventive |
| Example 43 | 1299 | 595 | 568 | 27 | 415 | 1.34 | 7.15 | C | Inventive |
| Example 44 | 1066 | 563 | 545 | 18 | 431 | 1.53 | 7.45 | B | Inventive |
| Example 45 | 1079 | 570 | 551 | 19 | 424 | 1.45 | 7.45 | B | Inventive |
| Example 46 | 1090 | 567 | | | 411 | 1.37 | 7.45 | A | Comparative |
| Example 47 | 1147 | 551 | 540 | 11 | 447 | 1.58 | 7.35 | B | Inventive |
| Example 48 | 1119 | 553 | 529 | 24 | 433 | 1.57 | 7.4 | C | Inventive |
| Example 49 | 1102 | 556 | 536 | 20 | 443 | 1.56 | 7.36 | C | Inventive |
| Example 50 | 1136 | 566 | 543 | 23 | 420 | 1.47 | 7.33 | C | Inventive |
| Example 51 | 1061 | 575 | | | 439 | 1.43 | 7.21 | A | Comparative |
| Example 52 | 1128 | 578 | 558 | 20 | 407 | 1.41 | 7.28 | B | Inventive |
| Example 53 | 1243 | 593 | 565 | 28 | 407 | 1.33 | 7.17 | C | Inventive |
| Example 54 | 1216 | 585 | 562 | 23 | 406 | 1.35 | 7.2 | B | Inventive |
| Example 55 | 1104 | 555 | | | 391 | Unmeasured | Unmeasured | A | Comparative |
| Example 56 | 1325 | 587 | | | 425 | Unmeasured | Unmeasured | A | Comparative |

TABLE 6

| | Melting point $T_m$ (° C.) | Crystallization temperature $T_x$ (° C.) | Glass transition temperature $T_g$ (° C.) | Supercooled-liquid region $\Delta T_x$ (° C.) | Curie temperature $T_c$ (° C.) | Saturation magnetization $J_s$ (T) | Density ρ (g/cm³) | Metallic glass | Remarks on Example |
|---|---|---|---|---|---|---|---|---|---|
| Example 26 | 1133 | 540 | 483 | 57 | 420 | 1.59 | 7.45 | B | Inventive |
| Example 27 | 1172 | 545 | 474 | 71 | 398 | 1.50 | 7.45 | B | Inventive |
| Example 28 | 1170 | 548 | 491 | 57 | 407 | 1.45 | 7.45 | B | Inventive |
| Example 29 | 1165 | 550 | 493 | 57 | 415 | 1.38 | 7.45 | B | Inventive |

The saturation magnetization Js (unit: T) of the soft magnetic material prepared in each example was measured. The results were shown in Tables 4 to 6. The soft magnetic materials (ribbons) prepared in Examples 5, 10, 15, and 22 were measured for coercive force Hc (unit: A/m). As a result, the coercive force Hc of the soft magnetic material prepared in Example 5 was 6.4 A/m, that in Example 10 was 4.0 A/m, that in Example 15 was 5.7 A/m, and that in Example 22 was 5.4 A/m. These soft magnetic materials (ribbons) exhibited good soft magnetic characteristics.

The composition of the Fe-based alloy composition prepared in each of Examples 9 to 15 and 44 to 46 can be represented by the following formula:

$$(Fe_{0.793}B_{0.143}C_{0.064})_{100at\ \%-}\alpha Si\alpha$$

where α is 0 at % to 12 at %.

Figure 4:
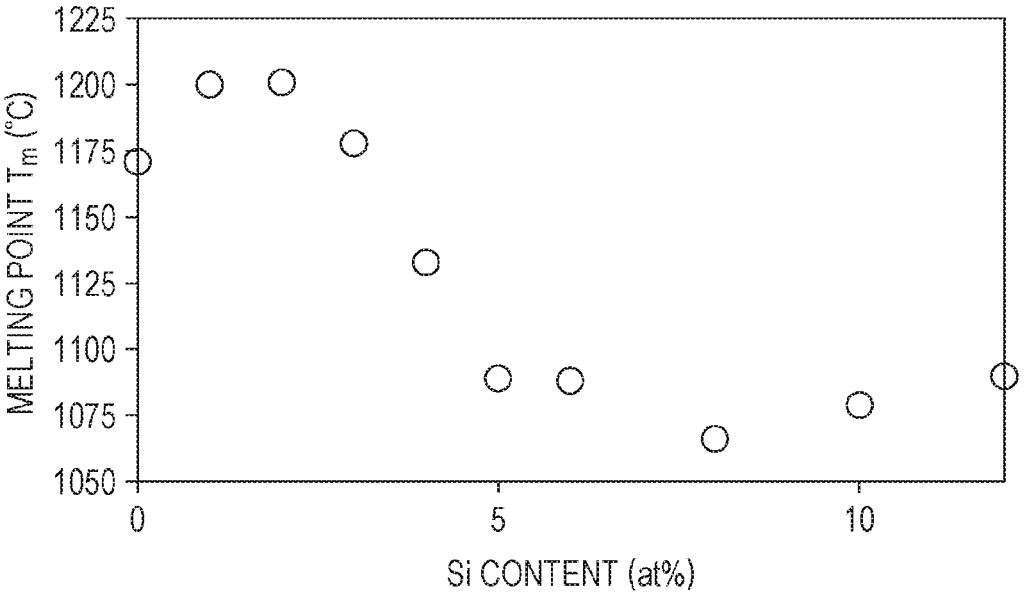
FIG. 4 is a graph showing the relationship between the melting point and Si content of an Fe-based alloy composition prepared in each example.
Figure 5:
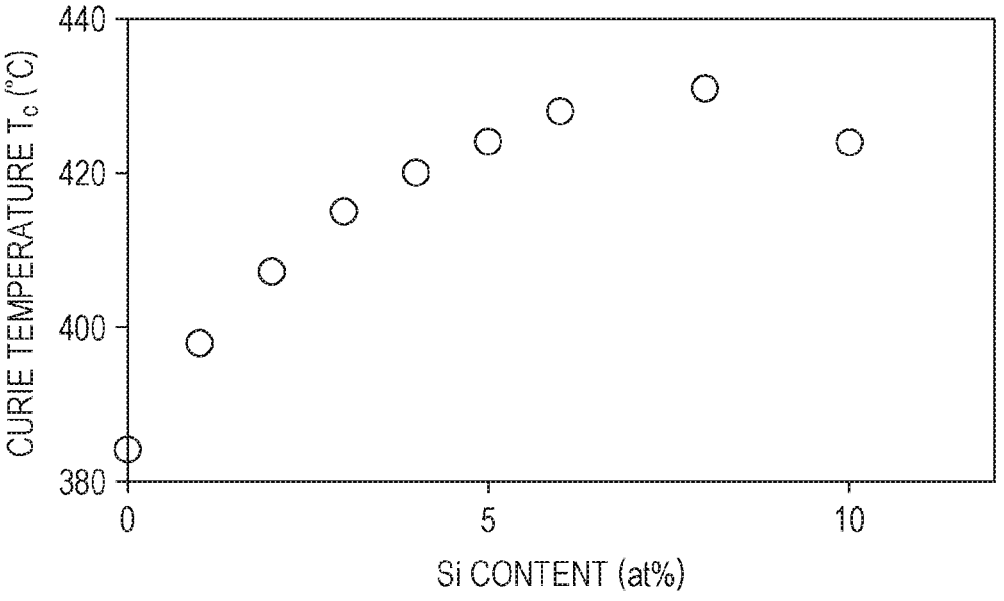
FIG. 5 is a graph showing the relationship between the Curie temperature and Si content of a ribbon which is an Fe-based amorphous soft magnetic material formed from an Fe-based alloy composition prepared in each example.
Figure 6:
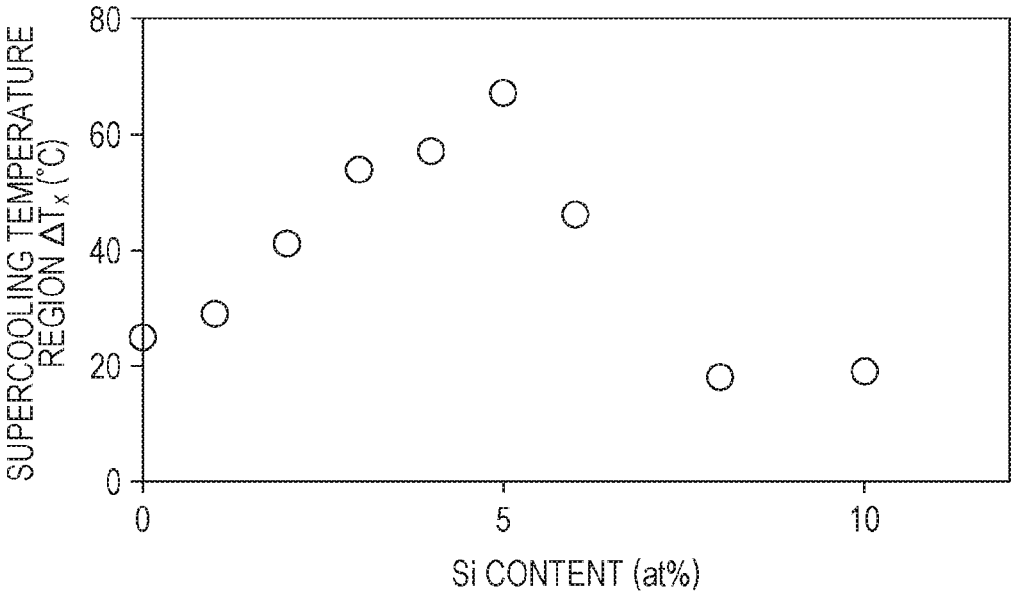
FIG. 6 is a graph showing the relationship between the supercooled-liquid region and Si content of a ribbon which is an Fe-based amorphous soft magnetic material formed from an Fe-based alloy composition prepared in each example.

Thus, the effect of adding Si, which serves as an amorphization element, can be confirmed by comparing Examples 9 to 15 and 44 to 46. The results are shown in FIGS. 4 to 6. FIG. 4 is a graph showing the relationship between the melting point $T_m$ and Si content of each Fe-based alloy composition. FIG. 5 is a graph showing the relationship between the Curie temperature $T_c$ and Si content of a ribbon which is an Fe-based amorphous soft magnetic material formed from the Fe-based alloy composition. FIG. 6 is a graph showing the relationship between the supercooled-liquid region $\Delta T_x$ and Si content of the ribbon, which is the Fe-based amorphous soft magnetic material formed from the Fe-based alloy composition.

As shown in FIG. 4, in the case of adding Si, as a basic tendency, it was observed that increasing the Si content from 0 at % to 1 at % tended to increase the melting point $T_m$ and increasing the Si content to more than 2 at % tended to reduce the melting point $T_m$. The reduction in melting point $T_m$ of an Fe-based alloy composition increases the handleability of a melt thereof, leading to the increase in productivity and quality of an Fe-based amorphous soft magnetic material.

As shown in FIG. 5, in the case of adding Si, it was observed that increasing the Si content up to 6 at % tended to increase the Curie temperature $T_c$ and increasing the Si content to more than 6 at % tended to conversely reduce the Curie temperature $T_c$. Increasing the Curie temperature $T_c$ contributes to increasing the guaranteed operating temperature of an electric/electronic component including a magnetic member formed using an Fe-based amorphous soft magnetic material.

As shown in FIG. 6, in the case of adding Si, it was observed that increasing the Si content up to 5 at % tended to increase the supercooled-liquid region $\Delta T_x$ and increasing the Si content to more than 5 at % tended to conversely reduce the supercooled-liquid region $\Delta T_x$. Increasing the supercooled-liquid region $\Delta T_x$ allows a magnetic member formed using an Fe-based amorphous soft magnetic material to be more readily annealed.

The composition of the Fe-based alloy composition prepared in each of Examples 26 to 29 can be represented by the following formula:

$$(Fe_{0.793-\beta}Cr_{\beta}B_{0.143}C_{0.064})_{96at\ \%}Si_{4at\ \%}$$

where β is 0 to 0.03.

Figure 7:
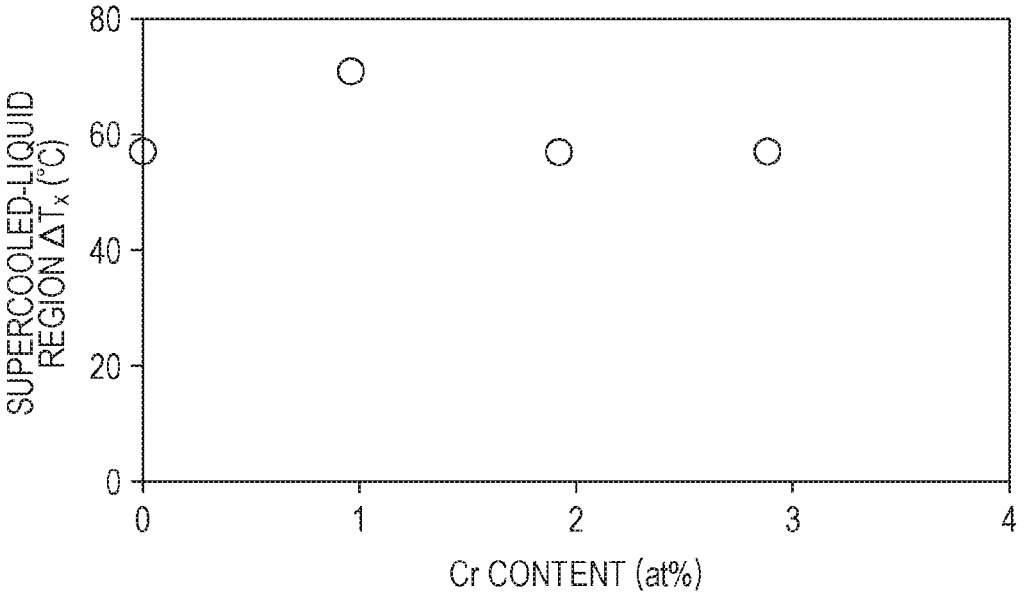
FIG. 7 is a graph showing the relationship between the supercooled-liquid region and Cr content of a ribbon which is an Fe-based amorphous soft magnetic material formed from each Fe-based alloy composition.

Thus, the effect of adding Cr, which serves as a substitution element for Fe, can be confirmed by comparing Examples 26 to 29. The results are shown in FIG. 7. FIG. 7 is a graph showing the relationship between the supercooled-liquid region $\Delta T_x$ and Cr content of a ribbon which is an Fe-based amorphous soft magnetic material formed from each Fe-based alloy composition. As shown in FIG. 7, partly substituting Fe with Cr caused no significant change in supercooled-liquid region $\Delta T_x$. Thus, it is expected that, even if partly substituting Fe in an Fe-based alloy composition with Cr up to about several atomic percent, the possibility that the ease of annealing a magnetic member formed using an Fe-based amorphous soft magnetic material formed from the Fe-based alloy composition varies significantly is low. Since Cr can impart corrosion resistance to the Fe-based amorphous soft magnetic material, the Fe-based alloy composition preferably contains Cr in the case where the Fe-based amorphous soft magnetic material is formed from the Fe-based alloy composition by a water atomization method.

Figure 8:
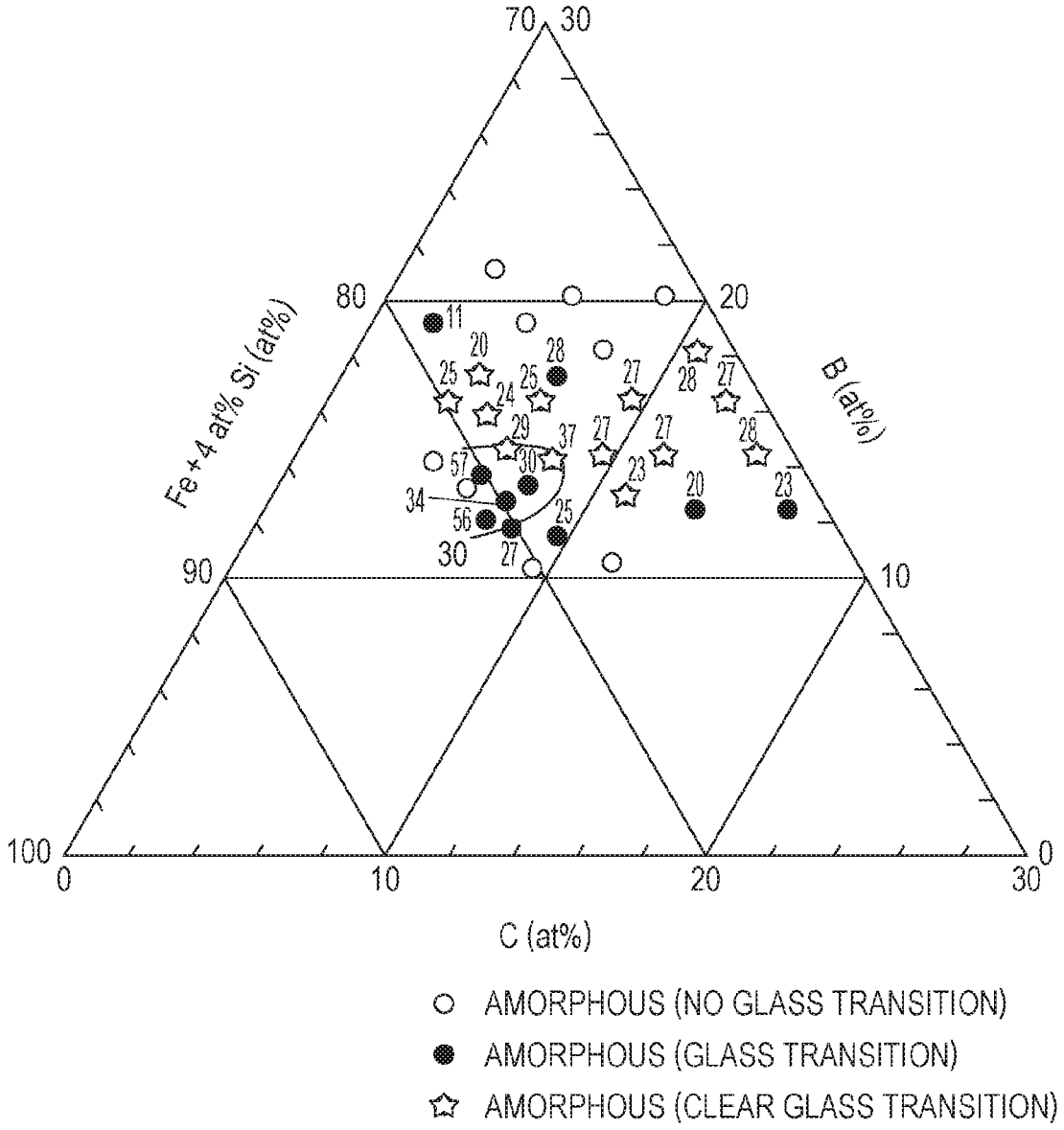
FIG. 8 is a pseudo-ternary phase diagram showing the relationship between whether the glass transition temperature $T_g$ is observed and the composition (the content of B, the content of C, and the content of Fe and Si) of Fe-based alloy compositions for Fe-based amorphous soft magnetic materials made of Fe-based alloy compositions prepared in examples.

FIG. 8 is a pseudo-ternary phase diagram showing the relationship between whether the glass transition temperature $T_g$ was observed and the composition (the content of B, the content of C, and the content of Fe and Si (4 at %)) of Fe-based alloy compositions for Fe-based amorphous soft magnetic materials formed from some (Examples 2, 4, 6, 8, 13, 17, 19, 21, 23, 25, 30 to 43, and 47 to 54) of the Fe-based alloy compositions, prepared in examples, having a Si content of 4 at % and containing no Cr. In FIG. 8, asterisks (*) represent Fe-based amorphous soft magnetic materials in which the glass transition temperature $T_g$ was clearly observed (an endothermic peak was clearly observed in a DSC chart), solid circles (●) represent Fe-based amorphous soft magnetic materials in which the glass transition temperature $T_g$ was observed not as clearly as that of those represented by the asterisks, and open circles (○) represent Fe-based amorphous soft magnetic materials in which no glass transition temperature $T_g$ was observed. Numerical values shown near these marks are the supercooled-liquid regions $\Delta T_x$ (unit: ° C.) of Fe-based amorphous soft magnetic materials.

As shown in FIG. 8, in Fe-based amorphous soft magnetic materials, prepared in examples (23 examples that are Examples 13, 17, 19, 21, 23, 25, 30, 31, 33, 36, 37, 39, 40, 42, 43, 47 to 50, and 52 to 54), within the compositional scope of the present invention, the glass transition temperature $T_g$ was observed. In particular, in Fe-based alloy compositions prepared in 12 examples that are Examples 25, 30, 33, 37, 39, 40, 42, 43, 48 to 50, and 53, the glass transition temperature $T_g$ was clearly observed. However, in Fe-based alloy compositions having a composition with an excessively low C content (Examples 2 and 4), Fe-based alloy compositions having a composition with an excessively low B content (Examples 8 and 32), and Fe-based alloy compositions having a composition with an excessively high B content (Examples 35, 38, and 41), no glass transition temperature $T_g$ was observed.

The fact that an Fe-based alloy composition within the compositional scope of the present invention is more likely to be produced than an Fe-based alloy composition outside the compositional scope thereof was confirmed as described below. In order to form soft magnetic materials having a ribbon shape from the Fe-based alloy composition prepared in Example 7 (outside the compositional scope of the present invention) and the Fe-based alloy composition prepared in Example 25 (within the compositional scope of the present invention), ribbons with different thicknesses were prepared by adjusting the drip rate of a melt, the rotational speed of a roll, or the like. In particular, two types (22 μm and 34 μm) of ribbons were prepared in Example 7 and six types (17 μm, 40 μm, 49 μm, 68 μm, 120 μm, and 135 μm) of ribbons were prepared in Example 25.

These ribbons were measured by X-ray diffraction using a Cu Kα radiation source, whereby X-ray diffraction spectra were obtained. The measurement results were shown in FIG. 9 (Example 7) and FIG. 10 (Example 25). As the thickness of a ribbon is larger, the cooling rate of an Fe-based alloy composition used to form the ribbon is lower and therefore crystals are more likely to be formed in the ribbon. Thus, as the lower limit of the thickness of a ribbon in which the formation of crystals is observed in an X-ray diffraction spectrum of the ribbon is larger, the amorphous formability of an Fe-based alloy composition is higher.

Figure 9:
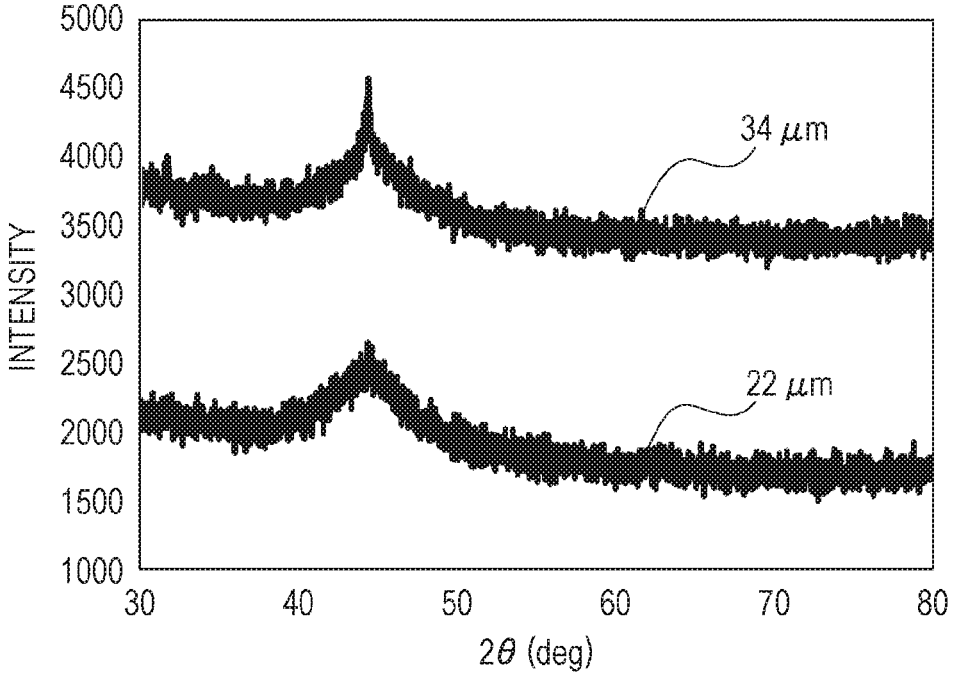
FIG. 9 is a graph showing an X-ray diffraction spectrum of a ribbon prepared in Example 7.
Figure 10:
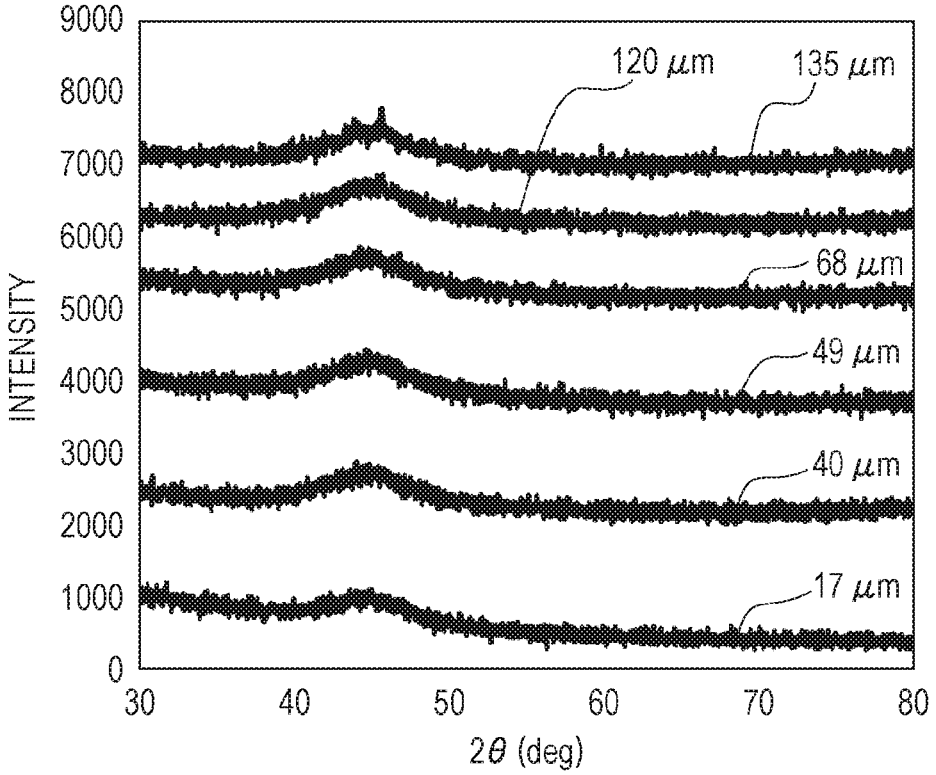
FIG. 10 is a graph showing an X-ray diffraction spectrum of a ribbon prepared in Example 25.

As shown in FIG. 9, among the ribbons formed from the Fe-based alloy composition, prepared in Example 7, having a composition outside the compositional scope of the present invention, in the ribbon with a thickness of 34 μm, a peak with a sharp tip was observed at about 45°. However, as shown in FIG. 10, among the ribbons formed from the Fe-based alloy composition, prepared in Example 25, having a composition within the compositional scope of the present invention, even in the ribbon with a thickness of 120 μm, no peak with a sharp tip was observed and, only in the ribbon with a thickness of 135 μm, a peak with a sharp tip was observed at about 45°. Thus, it was confirmed that the Fe-based alloy composition, prepared in Example 25, having a composition within the compositional scope of the present invention had higher amorphous formability as compared to the Fe-based alloy composition, prepared in Example 7, having a composition outside the compositional scope of the present invention.

Fe-based alloy compositions having a composition (unit: at %) shown in Table 7 were prepared. Incidentally, the composition of the Fe-based alloy composition prepared in each of Examples 58 and 59 was the same as that in Example 28 and the Fe-based alloy composition prepared in Reference Example 2 contained P.

TABLE 7

| | Composition | | | | | | |
|---|---|---|---|---|---|---|---|
| | at % | | | | | | |
| | Fe | Cr | P | B | C | Si | (B + c)/Fe |
| Reference Example 1 | 73 | 2.2 | 0.0 | 10.7 | 2.8 | 11.3 | 0.185 |
| Example 57 | 71.63 | 2.00 | 0.00 | 14.21 | 8.16 | 11.30 | 0.312 |
| Example 58 | 74.21 | 1.92 | 0.00 | 13.73 | 6.14 | 4.00 | 0.268 |
| Example 59 | 74.21 | 1.92 | 0.00 | 13.73 | 6.14 | 4.00 | 0.268 |
| Example 60 | 72.54 | 2.00 | 0.00 | 13.44 | 6.02 | 6.00 | 0.268 |
| Reference Example 2 | 74.3 | 1.5 | 8.8 | 2.6 | 7.6 | 5.2 | 0.137 |

Soft magnetic powders were prepared from these Fe-based alloy compositions by a water atomization method. All the soft magnetic powders were amorphous soft magnetic powders in which a primary phase was an amorphous phase. The soft magnetic powders were measured for particle size distribution by volume using a Microtrac particle size distribution analyzer, MT 3000 series, available from Nikkiso Co., Ltd. In a volume-based particle size distribution, the particle diameter D10 (10% volume-cumulative diameter), the particle diameter D50 (50% volume-cumulative diameter), and the particle diameter D90 (90% volume-cumulative diameter) in which the cumulative particle size distribution from the small particle size side accounts for 10%, 50%, and 90%, respectively, were as shown in Table 8.

TABLE 8

| | Core characteristics | | | | | | | |
|---|---|---|---|---|---|---|---|---|
| | Particle size distribution | | | Annealing temperature | Density | | Pcv | Remarks on |
| | D10/μm | D50/μm | D90/μm | (° C.) | (g/cm³) | μ | (kw/m³) | Example |
| Reference Example 1 | 4.56 | 11.7 | 26.6 | 450 | 5.64 | 58.8 | 380 | Reference |
| Example 57 | 4.91 | 10.9 | 20.2 | 410 | 5.58 | 37.4 | 558 | Inventive |
| Example 58 | 4.89 | 11.0 | 20.8 | 410 | 5.69 | 46.8 | 305 | Inventive |
| Example 59 | 5.35 | 12.5 | 24.7 | 420 | 5.70 | 43.4 | 362 | Inventive |
| Example 60 | 5.32 | 12.4 | 24.8 | 420 | 5.60 | 43.3 | 348 | Inventive |
| Reference Example 2 | 4.46 | 11.1 | 26.0 | 450 | 5.82 | 64.9 | 254 | Reference |

Slurry was obtained in such a manner that 97.2 parts by mass of each of the soft magnetic powders prepared in Examples 57 to 60 and a commercially available soft magnetic powder (a composition shown in Table 7) prepared in Reference Example 1, 2 parts by mass to 3 parts by mass of an insulating binding material composed of an acrylic resin and a phenol resin, and 0 parts by mass to 0.5 parts by mass of a lubricant made of zinc stearate were mixed with water serving as a solvent. A granular powder was obtained from the slurry.

The obtained granular powder was filled into a die and was press-molded with a surface pressure of 0.5 GPa to 1.5 GPa, whereby a ring-shaped molded product having an outside diameter of 20 mm, an inside diameter of 12 mm, and a thickness of 3 mm was obtained.

The obtained molded product was put in an oven with a nitrogen flow atmosphere and was heat-treated in such a manner that the temperature in the oven was increased from room temperature (23° C.) to an annealing temperature shown in Table 8 at a heating rate of 10° C./min, was maintained at this temperature for 1 hour, and was then cooled to room temperature in the oven, whereby a toroidal core composed of a dust core was obtained. Results obtained by measuring the density of the toroidal cores were shown in Table 8.

A coated copper wire was wound around each of the toroidal cores 40 times, whereby a toroidal coil was obtained. The toroidal coils were measured for relative permeability μ a frequency of 100 kHz using an impedance analyzer, 4192A, available from Hewlett-Packard Company. The measurement results were shown in Table 8.

A toroidal coil obtained by winding a coated copper wire around the primary side and secondary side of each of the toroidal cores 40 times and 10 times, respectively, was measured for core loss Pcv (unit: $kW/m^3$) at a measurement frequency of 100 kHz using a BH analyzer, SY-8218, available from Iwatsu Electric Co., Ltd. under such conditions that the maximum effective magnetic flux density Bm was 100 mT.

As shown in Table 8, magnetic characteristics of the toroidal cores obtained from the soft magnetic powders having a composition within the scope of the present invention are substantially equal to magnetic characteristics of the toroidal core obtained from the commercially available amorphous soft magnetic powder or the amorphous soft magnetic powder having a composition containing P.

What is claimed is:

1. An Fe-based alloy composition capable of forming a soft magnetic material which contains an amorphous phase having a glass transition temperature $T_g$, the Fe-based alloy composition having a composition represented by the formula $(Fe_{1-a}T_a)_{100at\ \%-(x+b+c+d)}M_xB_bC_cSi_d$, where T is an optional additive which is at least one element selected from the group consisting of Co and Ni, and M is an optional additive which is Cr, wherein the formula satisfies:

a first set of conditions including $0 \le a \le 0.3$, 11.0 at $\% \le b \le 18.20$ at %, 6.00 at $\% \le c \le 17$ at %, 0 at $\% \le d \le 10$ at %, 0.5 at $\% \le x \le 4$ at %, and $0.25 \le R \le 0.333$, where $R=(b+c)/[(1-a)\times\{100 \text{ at } \%-(x+b+c+d)\}]$.

2. The Fe-based alloy composition according to claim 1, wherein in the first set of conditions, $0.261 \le R \le 0.333$.

3. The Fe-based alloy composition according to claim 1, wherein the content of Cr is 0.5 at % to 2.88 at %.

4. The Fe-based alloy composition according to claim 1, wherein the content of Cr is 0.96 at % to 4 at %.

5. The Fe-based alloy composition according to claim 1, wherein in the first set of conditions, the formula further satisfies 11.52 at $\% \le b \le 18.14$ at %.

6. The Fe-based alloy composition according to claim 1, wherein in the first set of conditions, the formula further satisfies 6.00 at $\% \le c \le 16.32$ at %.

7. The Fe-based alloy composition according to claim 1, wherein saturation magnetization of the Fe-based alloy composition is 1.56 T or more.

8. The Fe-based alloy composition according to claim 1, wherein in the first set of conditions, 100 at %−(x+b+c+d) is 67.20 at % to 80.00 at %.

9. A soft magnetic material having the composition of the Fe-based alloy composition according to claim 1, the soft magnetic material containing the amorphous phase having the glass transition temperature $T_g$.

10. The soft magnetic material according to claim 9, wherein the soft magnetic material having a supercooled-liquid region $\Delta T_x$ equal to or greater than 25° C., the supercooled-liquid region being defined by a temperature difference $(T_x-T_g)$ between a crystallization onset temperature $T_x$ and the glass transition temperature $T_g$ of the soft magnetic material.

11. A magnetic member containing the soft magnetic material according to claim 9.

12. The magnetic member according to claim 11, the magnetic member being a magnetic core or a magnetic sheet.

13. An electric/electronic component comprising the magnetic member according to claim 12.

14. A device comprising the electric/electronic component according to claim 13.

* * * * *